US007375071B2

(12) United States Patent
Kischkel et al.

(10) Patent No.: US 7,375,071 B2
(45) Date of Patent: May 20, 2008

(54) LIQUID DETERGENT COMPRISING ANIONIC AND NONIONIC SURFACTANT MIXTURES

(75) Inventors: Ditmar Kischkel, Monheim (DE); Manfred Weuthen, Langenfeld (DE); Rolf Wachter, Duesseldorf (DE); Joerg Schad, Haan (DE)

(73) Assignee: Cognis IP Management GmbH, Duesseldorf (DE)

( * ) Notice: Subject to any disclaimer, the term of this patent is extended or adjusted under 35 U.S.C. 154(b) by 0 days.

(21) Appl. No.: 11/243,244

(22) Filed: Oct. 4, 2005

(65) Prior Publication Data

US 2006/0074005 A1 Apr. 6, 2006

(30) Foreign Application Priority Data

Oct. 5, 2004 (DE) ..... 10 2004 048 752

(51) Int. Cl.

| | |
|---|---|
| ***C11D 1/83*** | (2006.01) |
| ***C11D 3/22*** | (2006.01) |
| ***C11D 1/72*** | (2006.01) |
| ***C11D 1/14*** | (2006.01) |
| ***C11D 1/04*** | (2006.01) |

(52) U.S. Cl. ..... 510/355; 510/276; 510/289; 510/290; 510/316; 510/331; 510/340; 510/351; 510/353; 510/356; 510/357; 510/358; 510/389; 510/421; 510/422; 510/426; 510/427; 510/430; 510/470; 510/481; 510/504

(58) Field of Classification Search ..... 510/276, 510/289, 290, 316, 331, 340, 351, 353, 355, 510/356, 357, 358, 389, 421, 422, 426, 427
See application file for complete search history.

(56) References Cited

U.S. PATENT DOCUMENTS

| | | | | |
|---|---|---|---|---|
| 4,259,215 | A | 3/1981 | Murata et al. | |
| 5,409,628 | A * | 4/1995 | Heinz et al. | 510/122 |
| 5,534,248 | A * | 7/1996 | Matsuo et al. | 424/70.28 |
| 5,580,494 | A * | 12/1996 | Sandhu et al. | 510/125 |
| 5,811,087 | A * | 9/1998 | Mohring et al. | 424/70.19 |
| 6,024,952 | A * | 2/2000 | Story et al. | 424/78.03 |
| 6,090,773 | A * | 7/2000 | Lukenbach et al. | 510/475 |
| 6,127,494 | A * | 10/2000 | Larson | 526/80 |
| 6,221,816 | B1 * | 4/2001 | Kasuga et al. | 510/119 |
| 6,524,614 | B2 * | 2/2003 | Cannell et al. | 424/450 |
| 6,531,442 | B1 | 3/2003 | Durbut et al. | |
| 6,608,011 | B2 * | 8/2003 | Patel et al. | 510/124 |
| 6,903,057 | B1 * | 6/2005 | Tsaur | 510/130 |
| 2003/0147834 | A1 * | 8/2003 | Rollat et al. | 424/70.16 |
| 2004/0136942 | A1 * | 7/2004 | Yamazaki | 424/70.17 |
| 2004/0152617 | A1 * | 8/2004 | Murphy et al. | 510/475 |
| 2005/0119151 | A1 * | 6/2005 | Mayer et al. | 510/476 |
| 2005/0158269 | A1 * | 7/2005 | Simonet | 424/70.21 |
| 2005/0220736 | A1 * | 10/2005 | Polonka et al. | 424/63 |
| 2006/0009370 | A1 * | 1/2006 | Zuechner et al. | 510/507 |
| 2006/0025318 | A1 * | 2/2006 | Maubru et al. | 510/119 |
| 2006/0121807 | A1 * | 6/2006 | Albrecht et al. | 442/121 |

FOREIGN PATENT DOCUMENTS

| | | |
|---|---|---|
| EP | 0 462 806 B1 | 1/1997 |
| EP | 0 894 489 A1 | 2/1999 |
| WO | WO 03/038029 A1 | 5/2003 |
| WO | WO 03/057815 A1 | 7/2003 |

* cited by examiner

*Primary Examiner*—Charles Boyer
(74) *Attorney, Agent, or Firm*—John F. Daniels; Richard A. Elder

(57) ABSTRACT

Liquid compositions containing one or more anionic surfactants in combination with one or more polydiallyl dialkyl ammonium compounds or derivatives or copolymers thereof, these compositions being suitable for the production of liquid laundry detergents, preferably for dye-transfer-inhibiting liquid color-protecting detergents.

12 Claims, No Drawings

LIQUID DETERGENT COMPRISING ANIONIC AND NONIONIC SURFACTANT MIXTURES

CROSS-REFERENCE TO RELATED APPLICATIONS

This application claims priority from German application number DE 102004048752.9 filed Oct. 5, 2004, the entire contents of which are incorporated herein by reference.

FIELD OF THE INVENTION

This invention relates to liquid compositions containing polydiallyl dimethyl ammonium compounds, anionic surfactants and optionally water. These compositions are suitable for preventing dye transfer in wash liquors and, more particularly, for the production of liquid color detergents.

BACKGROUND OF THE INVENTION

Liquid color detergents are an independent product category in the detergent market. They are distinguished from conventional laundry detergents by special color protection of the laundry. So-called dye transfer inhibitors are intended to reduce any transfer of dye from one article of clothing to another. Known and standard transfer inhibitors are polyvinyl pyrrolidone (PVP) and derivatives thereof such as, for example, PVP N oxide or PVP betaines. In addition, a large number of cationic polymers have been described as dye transfer inhibitors and as dye fixing agents in laundry detergents and fabric care preparations. Such cationic polymers also include polydiallyl dimethyl ammonium chloride. Thus, EP 0 462 806-A2 describes a laundry detergent containing 0.01 to 50% by weight of a cationic dye-fixing agent and 1 to 50% by weight of a nonionic surfactant. The polydiallyl dimethyl ammonium chloride is disclosed as a suitable dye-fixing agent. WO 03/057815 A1 describes solid granules containing 1 to 90% by weight of a water-soluble dye-fixing agent. Polydiallyl dimethyl ammonium compounds, more particularly salts and copolymers, are also disclosed as suitable dye-fixing agents. However, only solid compositions containing polydiallyl dimethyl ammonium chloride in combination with anionic surfactants have been known hitherto. Liquid laundry detergent formulations containing polydiallyl dimethyl ammonium chloride have so far been free from anionic surfactants.

BRIEF DESCRIPTION OF THE INVENTION

It has now surprisingly been found that liquid detergents containing anionic surfactants can be stably formulated with polydiallyl dialkyl ammonium compounds, preferably the chlorides. Accordingly, in a first embodiment, the present invention relates to liquid compositions containing a) at least one polydiallyl dialkyl ammonium compound, b) at least one anionic surfactant and c) at least 16% by weight water. Polydiallyl dialkyl ammonium chloride is preferably selected as component a). Polymers with a molecular weight of 1,000 to 1,000,000 are suitable, polymers with a molecular weight in the range from 1,000 to 100,000 being particularly suitable. Polymers having a molecular weight of 2,000 to 20,000 can be particularly preferred. Polydiallyl dialkyl ammonium compounds in the context of the invention are known and commercially obtainable. The alkyl groups in these polymers may preferably contain 1 to 18 carbon atoms and preferably 1 to 4 carbon atoms. Polydiallyl dimethyl ammonium chloride is particularly preferred. It is marketed, for example, under the name of Tinofix FRD® or Lupasol®. Such products preferably have Brookfield viscosities of 200 to 400 mPas. The active substance content (AS) is typically up to 30 to 50%. Besides the salts, copolymers of polydiallyl dimethyl ammonium, more particularly copolymers with acrylic acid, methacrylic acid, acrylamides or vinyl pyrrolidones, may also be used in principle for the purposes of the present technical teaching.

DETAILED DESCRIPTION OF THE INVENTION

Besides the polydiallyl dimethyl ammonium compounds, the compositions according to the present invention also contain anionic surfactants. Typical examples of anionic surfactants are alkyl benzenesulfonates, alkane sulfonates, olefin sulfonates, alkyl ether sulfonates, glycerol ether sulfonates, α-methyl ester sulfonates, sulfofatty acids, alkyl sulfates, glycerol ether sulfates, fatty acid ether sulfates, hydroxy mixed ether sulfates, monoglyceride(ether)sulfates, fatty acid amide(ether)sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (especially wheat-based vegetable products) and alkyl (ether)phosphates. If the anionic surfactants contain polyglycol ether chains, the polyglycol ether chains may have a conventional homolog distribution, although they preferably have a narrow homolog distribution.

Alkyl and/or alkenyl ether sulfates are preferably selected. Alkyl and/or alkenyl ether sulfates suitable for use as component (b) are known and commercially obtainable sulfation products of linear fatty alcohols or partly branched oxoalcohols. They preferably correspond to formula (I):

$$RO(CH_2CH_2O)_nSO_3X \quad (I)$$

in which R is a linear or branched alkyl and/or alkenyl group containing 6 to 22 carbon atoms, n is a number of 1 to 10 and X is an alkali metal and/or alkaline earth metal, ammonium, alkylammonium, alkanolammonium or glucammonium. Ether sulfates of the type mentioned are industrially produced by sulfation and subsequent neutralization of the corresponding alcohol polyglycol ethers. Typical examples are the sulfates based on addition products of 1 to 10 and, more particularly, 2 to 5 mol ethylene oxide onto caproic alcohol, caprylic alcohol, 2-ethyl hexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol and brassidyl alcohol and technical mixtures thereof in the form of their sodium, potassium or magnesium salts.

Another class of preferred anionic surfactants are the alkyl benzenesulfonates (ABS) which preferably correspond to the formula R'-Ph-$SO_3X$ in which R' is a branched, but preferably linear, alkyl chain containing 10 to 18 carbon atoms, Ph is a phenyl group and X is an alkali and/or alkaline earth metal, ammonium, alkyl ammonium, alkanolammonium or glucammonium. Dodecylbenzene sulfonates, tetradecylbenzene sulfonates, hexadecylbenzene sulfonates and technical mixtures thereof in the form of the sodium salts are preferably used.

Soaps, preferably sodium and potassium soaps, may also be present in the compositions according to the invention in addition to or instead of the alkyl and/or alkenyl ether sulfates or ABS preferably used. The ethanolamine salts are also suitable. Quantities of 1 to 45% by weight, preferably 1 to 40% by weight and more particularly 30% by weight, preferably up to 15% by weight, are preferred. The potassium soaps and more especially the sodium soaps of $C_{12-18}$ fatty acids are preferably used.

Another preferred aspect is the fact that it has been found to be of advantage if component b), i.e. the anionic surfactant or surfactant mixture, is present in an at least 3- to 5-fold, preferably 5-fold, excess by weight over component a). Particularly preferred compositions contain anionic surfactants b) in quantities of 0.5 to 70% by weight, preferably in quantities of 0.5 to 50% by weight and more particularly in quantities of 1 to 25% by weight, based on the composition. Other preferred compositions contain component a) in quantities of 0.05 to 14% by weight, preferably in quantities of 0.01 to 10% by weight and more particularly in quantities of 0.1 to 5% by weight, based on the composition. Compositions according to the invention are liquid, i.e. pumpable at room temperature (21° C.). However, the present technical teaching does not encompass solid compositions, i.e. granules or powders, etc. The liquid compositions according to the invention preferably have Hoppler viscosities (as measured at 20° C.) of 15,000 to at most 50,000 mPas, although the range from 50 to 5,000 can also be preferred.

Water as component c) is compulsorily present in quantities of 16% by weight, based on the composition. However, the compositions according to the invention may also be present in heavily diluted form and, in that case, contain up to 95% by weight water. However, they preferably contain less water, for example from 20 to 80% by weight, preferably from 20 to 60% by weight and more particularly from 20 to 40% by weight water.

Besides components a), b) and c) described above, the liquid compositions according to the invention may contain other surfactants, more particularly nonionic surfactants and especially nonionic surfactants selected from the class of alkyl(oligo)glycosides, fatty alcohols and/or alkoxylated, preferably ethoxylated, fatty alcohols.

Alkyl and alkenyl oligoglycosides are known nonionic surfactants which correspond to formula (II):

$$R^1O\text{-}[G]_p \qquad \text{(II)}$$

where $R^1$ is an alkyl and/or alkenyl group containing 4 to 22 carbon atoms, G is a sugar unit containing 5 or 6 carbon atoms and p is a number of 1 to 10. They may be obtained by the relevant methods of preparative organic chemistry. The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl group $R^1$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl (oligo)glucosides having a chain length of $C_8$ to $C_{10}$ (DP=1 to 3), which are obtained as first runnings in the separation of technical $C_{8-18}$ coconut oil fatty alcohol by distillation and which may contain less than 6% by weight of $C_{12}$ alcohol as an impurity, and also alkyl oligo-glucosides based on technical $C_{9/11}$ oxoalcohols (DP=1 to 3) are preferred. In addition, the alkyl or alkenyl group $R^1$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut oil alcohol with a DP of 1 to 3 are preferred.

Alcohol ethoxylates are known from their production as fatty alcohol or as oxoalcohol ethoxylates and preferably correspond to formula (III):

$$R^2O(CH_2CH_2O)_nH \qquad \text{(III)}$$

in which $R^2$ is a linear or branched alkyl and/or alkenyl group containing 6 to 22 carbon atoms and n is a number of 1 to 50, preferably 3 to 30 and more particularly 3 to 12. Typical examples are the adducts of, on average, 1 to 50, preferably 5 to 40 and more particularly 10 to 25 mol of, for example, caproic alcohol, caprylic alcohol, capric alcohol, 2-ethylhexyl alcohol, capric alcohol, lauryl alcohol, isotridecyl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, arachyl alcohol, gadoleyl alcohol, behenyl alcohol, erucyl alcohol and brassidyl alcohol and the technical mixtures thereof obtained, for example, in the high-pressure hydrogenation of technical methyl esters based on fats and oils or aldehydes from Roelen's oxosynthesis and as monomer fraction in the dimerization of unsaturated fatty alcohols. Adducts of 10 to 40 mol ethylene oxide with technical $C_{12-18}$ fatty alcohols, such as for example coconut oil, palm oil, palm kernel oil or tallow fatty alcohol, are also preferred.

Besides the substances described above, any other nonionic, anionic, cationic and/or amphoteric surfactants may also be present as surfactants. Typical examples of nonionic surfactants are fatty alcohol polyglycol ethers, alkylphenol polyglycol ethers, fatty acid polyglycol esters, fatty acid amide polyglycol ethers, fatty amine polyglycol ethers, alkoxylated triglycerides, mixed ethers and mixed formals, optionally partly oxidized alk(en)yl oligoglycosides or glucuronic acid derivatives, fatty acid-N-alkyl glucamides, protein hydrolyzates (more particularly wheat-based vegetable products), polyol fatty acid esters, sugar esters, sorbitan esters, polysorbates and amine oxides. If the nonionic surfactants contain polyglycol ether chains, the polyglycol ether chains may have a conventional homolog distribution, although they preferably have a narrow homolog distribution.

Typical examples of cationic surfactants are quaternary ammonium compounds and esterquats, more particularly quaternized fatty acid trialkanolamine ester salts. Typical examples of amphoteric or zwitterionic surfactants are alkylbetaines, alkylamidobetaines, aminopropionates, aminoglycinates, imidazolinium betaines and sulfobetaines. The surfactants mentioned are all known compounds.

Compositions containing nonionic surfactants in quantities of 1 to 35% by weight, preferably 5 to 25% by weight and more particularly 5 to 20% by weight are preferably used. Another additional component may advantageously be soap which may advantageously be present in quantities of 1 to 40% by weight, preferably 10 to 38% by weight and more particularly 12 to 38% by weight, based on the total weight of the liquid composition. In another advantageous embodiment, the compositions according to the invention may be free from cationic surfactants and, more particularly, may be free from cationic fabric softeners. Particularly advantageous compositions contain a surfactant mixture consisting of anionic surfactants (other than soaps), alkyl (oligo)glycosides and fatty alcohol alkoxylates in a preferred ratio by weight of 1:1:4 to 1:1:2. Where soap is present, it is present in a ratio of preferably 4:1 relative to the other anionic surfactants also present. In addition, preferred surfactant mixtures contain anionic and/or nonionic surfactants in quantities of, in all, 50 to 80% by weight.

The compositions according to the invention preferably have a pH of 5.5 to 10 and more preferably in the range from 7.5 to 10. A pH in the range from 8.0 to 9.5 can be particularly preferred. The agents known to the expert, i.e. acids or alkalis, may be used to adjust the pH. The compositions described above are particularly suitable for the production of liquid laundry detergents. The above-described compositions are particularly suitable for the formulation of liquid laundry detergents. To this end, components a) to c) described above are formulated with other ingredients to produce the water-based liquid laundry detergents. A typical water-based liquid laundry detergent preferably contains (based on active substance) 5 to 25% by weight nonionic surfactants, 0.5 to 5% by weight anionic surfactants, 0 to 10% by weight soap, 0.01 to 1% by weight of a polydiallyl dialkyl ammonium compound and 0.01 to 2% by weight enzymes and also 0.1 to 15% by weight solubilizers or lower alcohols, such as glycerol, propanol or ethanol and other auxiliaries and additives, such as borax, organic carboxylic acids and/or salts thereof. The balance to 100% is water. Such a composition preferably has an active substance content of 10 to 20%. However, the compositions may also be formulated with higher active substance contents of 40 to 70%.

Another aspect of the present invention relates to the use of a mixture of a polydiallyl dimethyl ammonium compound and at least one anionic surfactant, the anionic surfactant being present in an at least 3- to 5-fold excess by weight over the polydiallyl dimethyl ammonium compound, as a dye transfer inhibitor in laundry detergents and preferably in liquid laundry detergents.

The present invention also relates to a liquid composition containing a) 60 to 88% by weight of a surfactant mixture containing at least two surfactants selected from the group of anionic surfactants except soaps, ethoxylated fatty alcohols and alkyl(oligo)glycosides, with the proviso that at least one anionic surfactant must be present, b) 0 to 38% by weight of soap, c) 0.1 to 1.5% by weight polydiallyl dialkyl ammonium chloride and d) 0 to 5% by weight water.

Liquid compositions such as these may advantageously be used in the form of concentrates which may be diluted with water to the desired in-use concentration by a detergent manufacturer. In one preferred embodiment, the compositions contain soap, preferably in quantities of 0.1 to 38% by weight and more particularly in quantities of 10 to 38% by weight. Such concentrates should preferably be pumpable at 20° C. However, the liquid concentrates may have Hoppler viscosities of up to 20,000 mPas (as measured at 60° C.).

The compositions described above preferably contain alkyl or alkenyl ether sulfates as anionic surfactants. In addition, compounds having the general formula $R^1O\text{-}[G]_p$, where $R^1$ is an alkyl and/or alkenyl group containing 4 to 22 carbon atoms, G is a sugar unit containing 5 or 6 carbon atoms and p is a number of 1 to 10, may be selected as the alkyl(oligo)glycosides. Other preferred compositions contain compounds having the general formula $R^2O—(C_2H_4O)_n—H$, where $R^2$ is a saturated, unsaturated, branched or unbranched alkyl group containing 8 to 22 carbon atoms and n is a number of 1 to 50. It can be of advantage if the described compositions contain anionic surfactants in at least 5 times the quantity of polydiallyl dialkyl ammonium chloride. In this connection, both the anionic surfactants of component a) and the soaps of component b) count as anionic surfactants. A particularly preferred component c) is polydiallyl dimethyl ammonium chloride.

Liquid preparations prepared from the above concentrates may have a non-aqueous component of 5 to 50% by weight and preferably 15 to 35% by weight. In the most simple case, such preparations are aqueous solutions of the mixtures mentioned. However, the concentrates described above may also be water-free preparations and, in that case, are used in the form of compounds. "Water-free" in the context of the invention means that the composition preferably contains no free water not bound as water of crystallization or in a comparable form. In some cases, small quantities of free water—more particularly 0.1 to 5% by weight—are tolerable.

The compositions used in the detergents field, preferably in liquid laundry detergents, may contain other typical ingredients such as, for example, builders, bleaching agents, bleach activators, solvents, detergency boosters, enzymes, enzyme stabilizers, viscosity adjusters, redeposition inhibitors, optical brighteners, soil repellents, foam inhibitors, inorganic salts and dyes and perfumes and the like.

Suitable liquid builders are ethylenediamine tetraacetic acid, nitrilotriacetic acid, citric acid and inorganic phosphonic acids such as, for example, the neutrally reacting sodium salts of 1-hydroxyethane-1,1-diphosphonate, which may be present in quantities of 0.5 to 5% by weight and preferably in quantities of 1 to 2% by weight.

The compositions described in the foregoing have a good dye-transfer-inhibiting effect and, at the same time, are stable in storage. Without wishing to be tied to this theory, applicants assume that, together with the polydiallyl dimethyl ammonium compounds, preferably the chlorides, the anionic surfactants form a stable complex which itself is capable of dispersing the dye molecules in aqueous solution or keeping them in solution. This is supported by the fact that an optimal effect is only obtained in a comparatively narrow quantity ratio between anionic surfactants and the dye transfer inhibitors according to the invention.

EXAMPLES

Two basic formulations of liquid laundry detergents as shown in the following Table were prepared.

TABLE 1

| | Detergent 1 | Detergent 2 |
|---|---|---|
| Water | 85% by weight | 85% by weight |
| $C_{12-18}$ fatty alcohol + 7EO | 11% by weight | 11% by weight |
| $C_{12-16}$-alkyl-1,4-glucoside | 2.5% by weight | 2.5% by weight |
| Cationic surfactant | 0% by weight | 2.5% by weight |

In order to test dye transfer, detergent solutions 1 and 2 were pre-diluted to a concentration of 350 g/l. 1 ml of the resulting solution was added to 68 ml of a dye solution (containing 0.0045 g/l Doramin blau 200%). 0.1 ml of a dilute aqueous solution of polydiallyl dimethyl ammonium chloride (concentration 0.35 g AS/100 ml) was added to the "dyed" wash liquor. The test solutions were heated with stirring (magnetic stirrer) to 40° C. Cotton test specimens measuring 6×2.5 cm (test fabric WFK 10A) were then added to each test solution. The color of the test specimens was measured beforehand with a Minolta CR 200 Chromameter in the L a b mode. The test specimens remained in the wash liquor with gentle stirring for 1 h at 40° C. The test specimens were then removed from the wash liquor and rinsed with tap water for 2 mins. After wringing, the color of the test specimens was measured with the Minolta CR 200 Chromameter in the L a b mode. The total color difference was calculated from the starting values and end values of the measurements.

The formulations were optionally augmented by anionic surfactants. The various volumes were made up with deionized water so that a volume of 70.1 ml test solution was present in every case. The results are set out in Table 2 below:

TABLE 2

| | Total color difference |
|---|---|
| Detergent 1 without polydiallyl dimethyl ammonium chloride | 16.3 |
| Detergent 1* | 28.15 |
| Detergent 1* + 10% by weight lauryl ether sulfate sodium salt | 6.35 |
| Detergent 1* + 5% by weight lauryl ether sulfate sodium salt | 4.47 |
| Detergent 1* + 3% by weight lauryl ether sulfate sodium salt | 3.68 |
| Detergent 1* + 1% by weight lauryl ether sulfate sodium salt | 4.05 |
| Detergent 1* + 0.5% by weight lauryl ether sulfate sodium salt | 4.57 |
| Detergent 1* + 0.2% by weight lauryl ether sulfate sodium salt | 19.62 |

*in the presence of polydiallyl dimethyl ammonium chloride

It can be seen that the total color difference decreases with the addition of anionic surfactants, but passes through an optimum at around 3% by weight.

Detergent 2 containing cationic surfactant was also tested in the presence and absence of the polydiallyl dimethyl ammonium chloride. For detergent 2, the measured color difference was 14.8 without the polydiallyl dimethyl ammonium chloride and 38.0 with the polydiallyl dimethyl ammonium chloride. This shows that the use of cationic surfactants leads to a deterioration in dye transfer inhibition.

We claim:

1. A liquid detergent comprising:

a) one or more polydiallyl dimethyl ammonium chlorides, b) a surfactant mixture comprising:

(i) one or more anionic surfactants (not including any soaps);

(ii) one or more soaps;

(iii) one or more alkyl (oligo)glycosides; and (iv) one or more fatty alcohol alkoxylates, and c) 20 to 95%, by weight, of water, wherein the one or more anionic surfactants (other than one or more soaps), the one or more alkyl (oligo)glycosides, and the one or more fatty alcohol alkoxylates are present in a ratio, by weight, of from 1:1:4 to 1:1:2.

2. The detergent as claimed in claim 1, wherein the one or more polydiallyl dimethyl ammonium chlorides of component a) is/are selected from polydiallyl dimethyl ammonium chlorides, with molecular weights of from 2,000 to 20,000.

3. The detergent as claimed in claim 1, wherein one or more of the anionic surfactants in component b) is/are selected from the group consisting of alkyl ether sulfates, alkenyl ether sulfates and mixtures of alkyl ether sulfates and alkenyl ether sulfates.

4. The detergent as claimed in claim 1, wherein the ratio, by weight, of component b) to component a) is at least 3:1.

5. The detergent as claimed in claim 1, wherein component a) is present as 0.05 to 14%, by weight of the detergent.

6. The detergent as claimed in claim 1, additionally containing one or more fatty alcohols.

7. The detergent as claimed in claim 6, wherein the one or more alkyl (oligo)glycosides, the one or more fatty alcohol alkoxylates, and the one or more fatty alcohols account, in the aggregate, for 1 to 35%, by weight of the detergent.

8. The detergent as claimed in claim 6, wherein the one or more anionic surfactants (not including soaps), the one or more alkyl (oligo)glycosides, the one or more fatty alcohol alkoxylates and the one or more fatty alcohols account, in the aggregate, for 50 to 80%, by weight of the detergent.

9. The detergent as claimed in claim 1, wherein the one or more soaps represent 1 to 40%, by weight of the detergent.

10. The detergent as claimed in claim 1 free of cationic surfactants.

11. The detergent as claimed in claim 1 free from cationic fabric softeners.

12. The detergent as claimed in claim 1 having a pH of 5.5 to 10.

* * * * *